US010602835B2

(12) United States Patent
Rennette

(10) Patent No.: US 10,602,835 B2
(45) Date of Patent: Mar. 31, 2020

(54) HAIR BRUSH WITH EJECTION SYSTEM

(71) Applicant: Olivia Garden International Inc., Walnut Creek, CA (US)

(72) Inventor: Jean Rennette, Walnut Creek, CA (US)

(73) Assignee: Olivia Garden International, Inc., Walnut Creek, CA (US)

( * ) Notice: Subject to any disclaimer, the term of this patent is extended or adjusted under 35 U.S.C. 154(b) by 0 days.

(21) Appl. No.: 16/300,479

(22) PCT Filed: Apr. 17, 2018

(86) PCT No.: PCT/US2018/027987

§ 371 (c)(1),
(2) Date: Nov. 9, 2018

(87) PCT Pub. No.: WO2018/195090

PCT Pub. Date: Oct. 25, 2018

(65) Prior Publication Data

US 2019/0142148 A1 May 16, 2019

Related U.S. Application Data

(60) Provisional application No. 62/487,843, filed on Apr. 20, 2017.

(51) Int. Cl.
*A46B 5/00* (2006.01)
*A46B 9/02* (2006.01)
(Continued)

(52) U.S. Cl.
CPC ..... *A46B 5/0095* (2013.01); *A45D 20/525* (2013.01); *A46B 7/04* (2013.01);
(Continued)

(58) Field of Classification Search
CPC ..... A45D 20/10; A45D 20/48; A45D 20/525; A45D 4/10; A46B 15/0051;
(Continued)

(56) References Cited

U.S. PATENT DOCUMENTS 4,289,857 A * 9/1981 Hoki ..... C08J 9/0047 521/143
4,754,516 A 7/1988 Tremblay
(Continued)

FOREIGN PATENT DOCUMENTS

KR 200383908 5/2005
KR 2020100004792 A 5/2010
KR 101058239 B1 8/2011

*Primary Examiner* — Yogesh P Patel
*Assistant Examiner* — Jennifer F Gill
(74) *Attorney, Agent, or Firm* — Volk & McElroy, LLP; Michael D. Volk, Jr.; Eric A. Hinojosa

(57) ABSTRACT

A hair brush system with a rapid, consistent, and efficient means for connecting and ejecting the brush handle from the brush head. The hair brushes feature a strong support member structure that gives the hairbrush strength while the handle and brush head are connected. The handle has a pair of barbed ejection fingers that engage and retain the brush head. When separation of the brush handle and the brush head is desired, the user depresses an actuator associated with each ejection finger. The compressed ejection finger has a tip that comes into contact with a conical protrusion in the brush head. The resulting action first disengages the brush head and then causes an outward force to be applied to the brush head thereby ejecting it from the handle.

18 Claims, 10 Drawing Sheets

(51) Int. Cl.
*A46B 15/00* (2006.01)
*A46B 7/04* (2006.01)
*A45D 20/52* (2006.01)

(52) U.S. Cl.
CPC ..... *A46B 7/042* (2013.01); *A46B 9/023* (2013.01); *A46B 15/00* (2013.01); *A46B 15/0055* (2013.01); *A45D 2200/25* (2013.01); *A46B 2200/104* (2013.01)

(58) Field of Classification Search
CPC ... A46B 2200/104; A46B 5/0095; A46B 7/04; A46B 7/042; A46B 9/023; Y10T 16/469; Y10T 16/4713
USPC ..... 132/313
See application file for complete search history.

(56) References Cited

U.S. PATENT DOCUMENTS 5,133,680 A 7/1992 Watson et al.
5,253,491 A 10/1993 Buontempo et al.
5,343,880 A * 9/1994 McKay ..... A45D 19/02 132/112
5,699,614 A 12/1997 Garneau
5,875,510 A * 3/1999 Lamond ..... A46B 5/0095 15/167.1
5,887,600 A * 3/1999 Wilk ..... A45D 6/04 132/150
6,029,307 A 2/2000 Baudoin
6,669,397 B1 * 12/2003 Christion ..... B25G 3/00 15/105
7,249,788 B2 7/2007 Muhammad et al.
D555,907 S 11/2007 Rennette
7,386,913 B2 6/2008 Jackson
D573,755 S 7/2008 Rennette
7,574,768 B2 8/2009 Morris et al.
D621,163 S 8/2010 Rennette
D624,321 S 9/2010 Rennette
D627,568 S 11/2010 Rennette
7,866,710 B2 1/2011 Sheppard et al.
D644,440 S 9/2011 Rennette
D646,488 S 10/2011 Rennette
D648,540 S 11/2011 Rennette
8,230,543 B2 7/2012 Shrier et al.
8,397,756 B2 3/2013 Packham et al.
D679,910 S 4/2013 Nimsgern
D684,373 S 6/2013 Rennette
D730,060 S 5/2015 Rennette
D730,061 S 5/2015 Rennette
D739,660 S 9/2015 Rennette
9,175,794 B2 11/2015 Lewcun
D749,326 S 2/2016 Rennette
D759,477 S 6/2016 Rennette
D762,069 S 7/2016 Rennette
D766,588 S 9/2016 Rennette
D775,839 S 1/2017 Rennette
D782,829 S 4/2017 Park
D798,607 S 10/2017 Park
D801,701 S 11/2017 Rennette
D801,702 S * 11/2017 Rennette ..... D4/138
D807,646 S 1/2018 Rennette
10,028,574 B2 7/2018 Rennette
2005/0121049 A1 * 6/2005 Rizzuto, Jr. ..... A45D 24/00 132/147
2005/0184518 A1 8/2005 Muhammad et al.
2009/0026762 A1 1/2009 Kitagawa
2010/0300470 A1 * 12/2010 Richardson ..... A45D 24/16 132/120
2012/0192893 A1 * 8/2012 Anderson ..... A45D 19/0008 132/219
2013/0312783 A1 * 11/2013 Fiorio ..... A46B 9/023 132/237
2013/0341917 A1 12/2013 Lehmann et al.
2014/0261526 A1 * 9/2014 Moll ..... A45D 2/2414 132/229
2015/0182779 A1 7/2015 Dalebout
2015/0342333 A1 12/2015 Park
2018/0242720 A1 8/2018 Geller et al.

* cited by examiner

HAIR BRUSH WITH EJECTION SYSTEM

DETAILED DESCRIPTION

Figure 1:
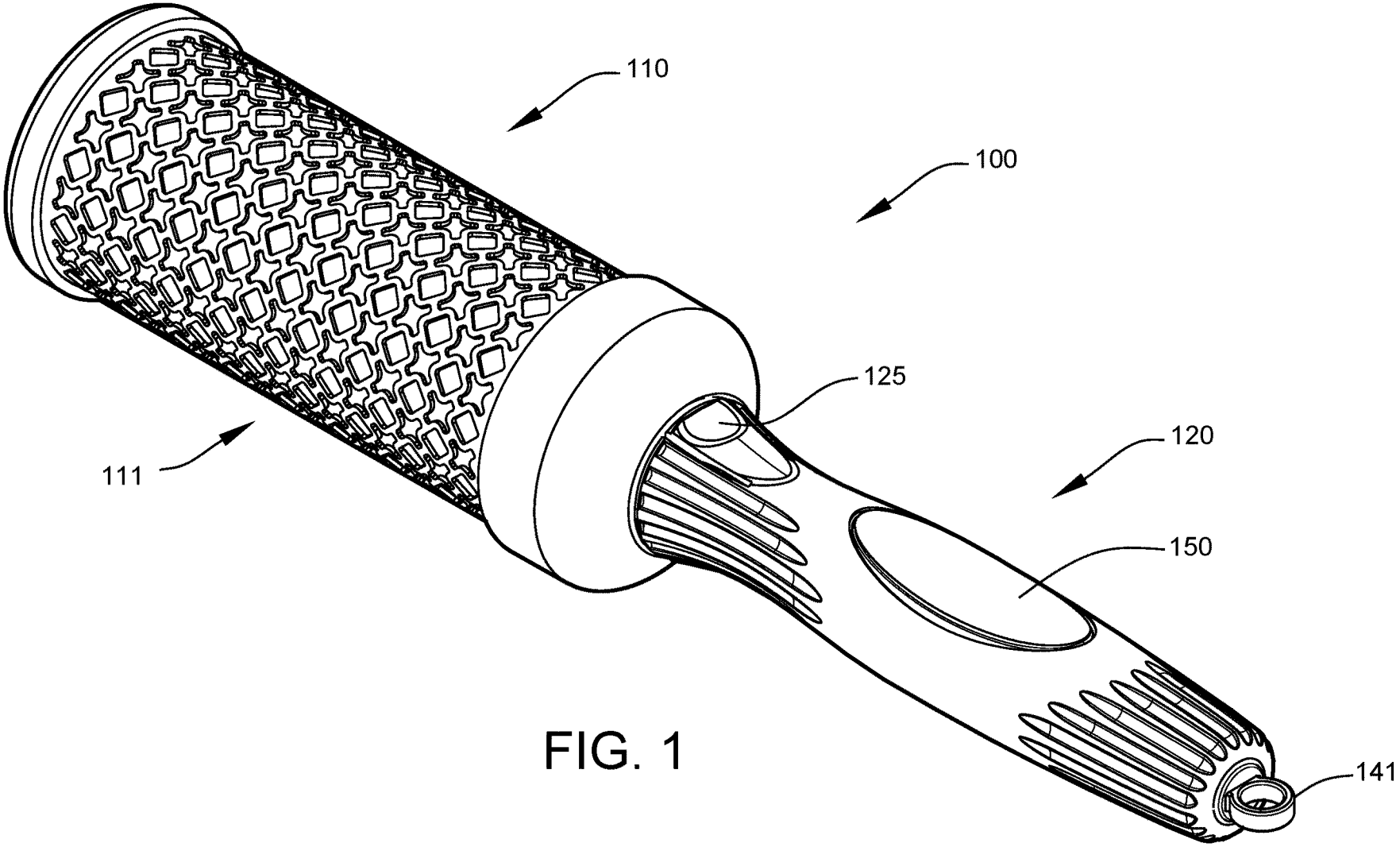
FIG. 1 is a perspective view showing a hair brush according to an implementation of the present disclosure.

Modern hair styles are extremely varied and diverse. Consequently, modern hair styling often requires the use of a variety of tools and techniques to achieve the intended style result. One styling maneuver has been the use of styling equipment such as rounded brushes, rollers, etc., as holders or forms to shape hair. This technique requires that one or more styling tools be applied to the hair and then left in place.

Brushes have the advantage of having a handle which makes them easier to manipulate into position. The handle improves the ease and efficiency of the initial application and the subsequent removal. However, while the brush is applied, the handle may become a burden for the hair that it blocks and/or disturbs. The weight of the handle may cause the position to be shifted if unsupported. The extra weight of the handle is also an inconvenience for the person upon whom the brush has been applied. Thus, when used, a brush must be held in place, typically by the person styling the hair. This causes a considerable increase in time to finish the styling. Rollers offer the benefit of being lighter and less cumbersome once applied, but they lack a handle that is useful for initial positioning and manipulation, as well as for subsequent removal of the brush from the hair.

The present disclosure describes a hair brush system having a brush with a rapid, consistent, and efficient means for engaging and separating a brush handle from a brush head. The hair brush further has a strong support member structure that gives the hairbrush strength while in use. The hair brush of the present disclosure features a handle with an ejection mechanism that forcibly ejects the brush head portion away from the handle portion. When separation of the brush handle and the brush head is desired, a user depresses or squeezes a pair of depressions each formed into or in contact with at least one ejection finger. This action first disengages the brush head and then causes an outward force to be applied to the brush head as each of the at least one ejection fingers contacts an angled surface within the brush head. This ejection of the brush greatly improves the ease of use especially when operated single-handedly, leaving the user's other hand free to perform additional tasks, for example, drying the hair being styled with a hair dryer. When the brush head and handle of the hair brush of the present disclosure are in the connected state, the brush head is mechanically supported by the engagement of a male member of the handle and a female opening of the brush head. The male member and female opening are configured to correspond and align in at least one orientation. It is noted that the ejection mechanism is highly useful because the user does not have to touch the ejected brush head. When styling hair, a hair brush and hair dryer are used. The brush heads retain heat (especially brush head comprising ceramic) and will be hot to the touch. The ejection system of the present disclosure prevents skin burns since the brush head is ejected and does not need to be touched with the hands or fingers to be left in place. Further, the stylist can keep the hair dryer in one hand and the ejected handle in the other. In other words, the stylist does not have to put the hair dryer down to eject the handle from the brush head. A stylist can use several brush heads with a single handle to add multiple brush head "rollers" to the hair. The systems of the present disclosure also utilize a depression that is depressed or squeezed from two sides with the thumb and forefinger. The depressions are positioned such that when the handle is naturally gripped, the thumb and forefinger can easily squeeze the depressions to eject the brush head. Further, the use of depressions allows the user to find the depressions by feel. The depressions may be found without the need for a visual inspection of the handle; the depressions are felt by the stylist or user.

Some implementations of the hair brush of the present disclosure also optionally feature a cavity in the handle wherein a removable hair sectioning pick may be stored in a first position. The cavity can also engage and retain the hair sectioning pick in a second position where the hair separator is not stored but rather extends outward from the handle.

The present disclosure describes and illustrates with a certain degree of detail various generalized and particular implementations of hair brushes. Some of the implementations will correspond to drawings that are referenced. However, others may not be depicted. Furthermore, the drawings have been shown with a basic brush head devoid of bristles, teeth, etc. This is done for sake of simplicity and clarity of the drawings, since it is readily understood in the art that brushes come in various styles, designs, dimensions, and so on—all of which are interchangeable with regards to the present disclosure. For example, a first user may desire a small diameter barrel with stiff bristles for that user's intended use, whereas a second user may desire a large diameter barrel with flexible bristles for that user's intended use, and whereas a third user may desire a multitude of differing brush heads. It should be noted that while the term "barrel" is often used to describe a portion of the brush head, there are alternative brush head designs that may not feature a full barrel. Some brush head designs feature a non-cylindrical barrel and others feature no barrel at all. The substitution of one style of brush head for another will not impede the applicability of the present disclosure on implementations of the hair brush system hereof. Therefore, the use of the term "barrel" should not be considered to limit the present disclosure to only those brushes featuring a traditional barrel style brush head.

FIG. 1 is a perspective view showing a hair brush 100 according to an implementation of the present disclosure. Hair brush 100 comprises brush head 110 connected to handle 120. Brush head 110 disengages from handle 120. When brush head 110 is disengaged, it is forcibly ejected away from the handle 120.

Figure 2:
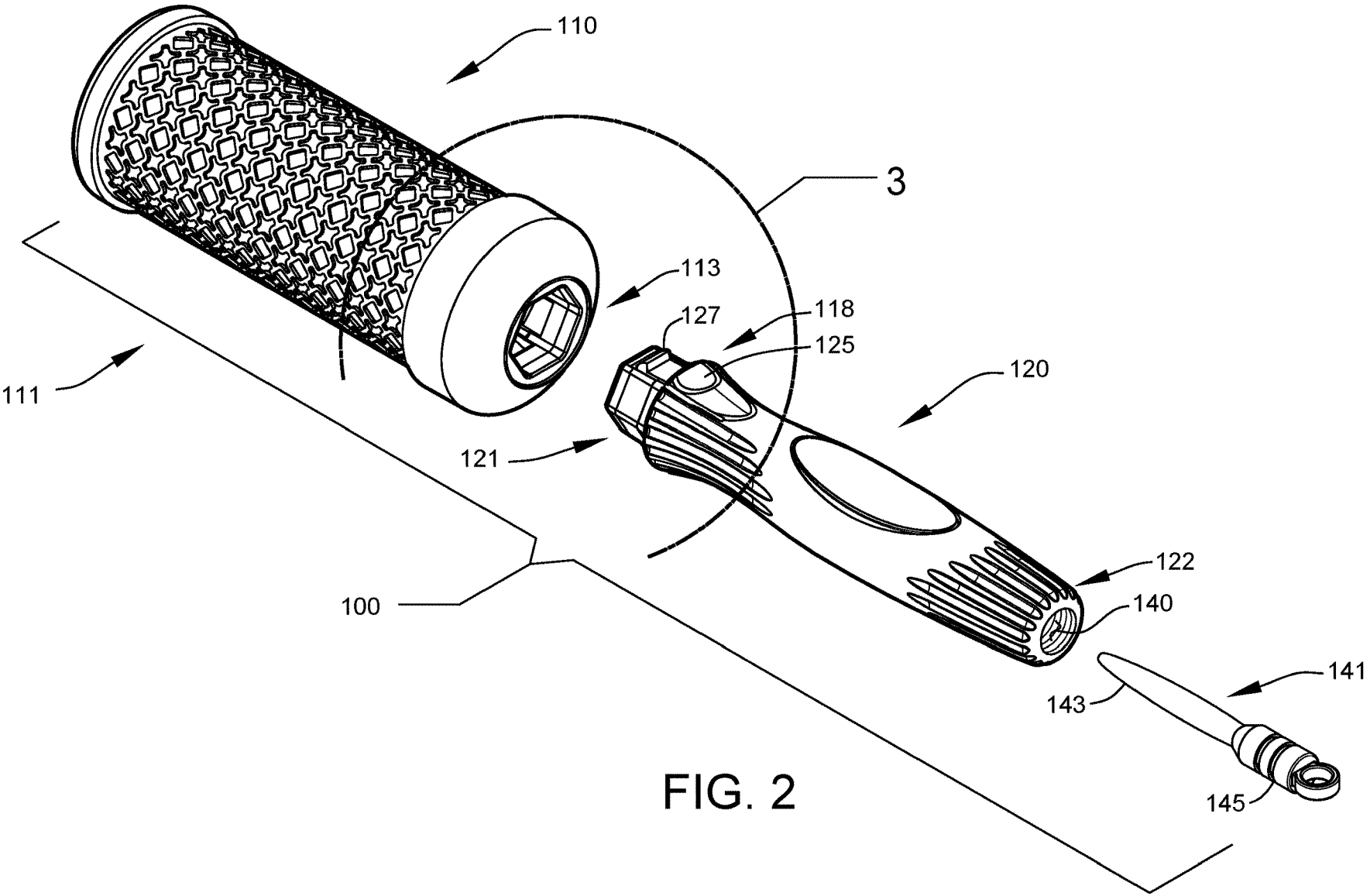
FIG. 2 is an exploded view of the hair brush of FIG. 1 where the brush head, handle, and hair sectioning pick are separated.

FIG. 2 is an exploded view of the hair brush of FIG. 1 where the brush head, handle, and hair sectioning pick are separated. Brush head 110 comprises a barrel portion 111 having two opposing ends, wherein a female opening 113 is positioned on at least one of the said two opposing ends, as shown. Female opening 113 and barrel portion 111 may be formed into the barrel portion 111 (such as when the material is cast in a uni-body mold, 3D printed, carved, etc.). Alternatively, the female opening 113 and barrel portion can be joined together via many different means such as fasteners (such as screws, nails, staples, etc.), fusing, adhesives (such as glue), clips, etc. Handle 120 comprises a first distal end 118 and second distal end 122, wherein a male member 121—that is configured to engage with female opening 113—is positioned on first distal end 118.

Figure 3A:
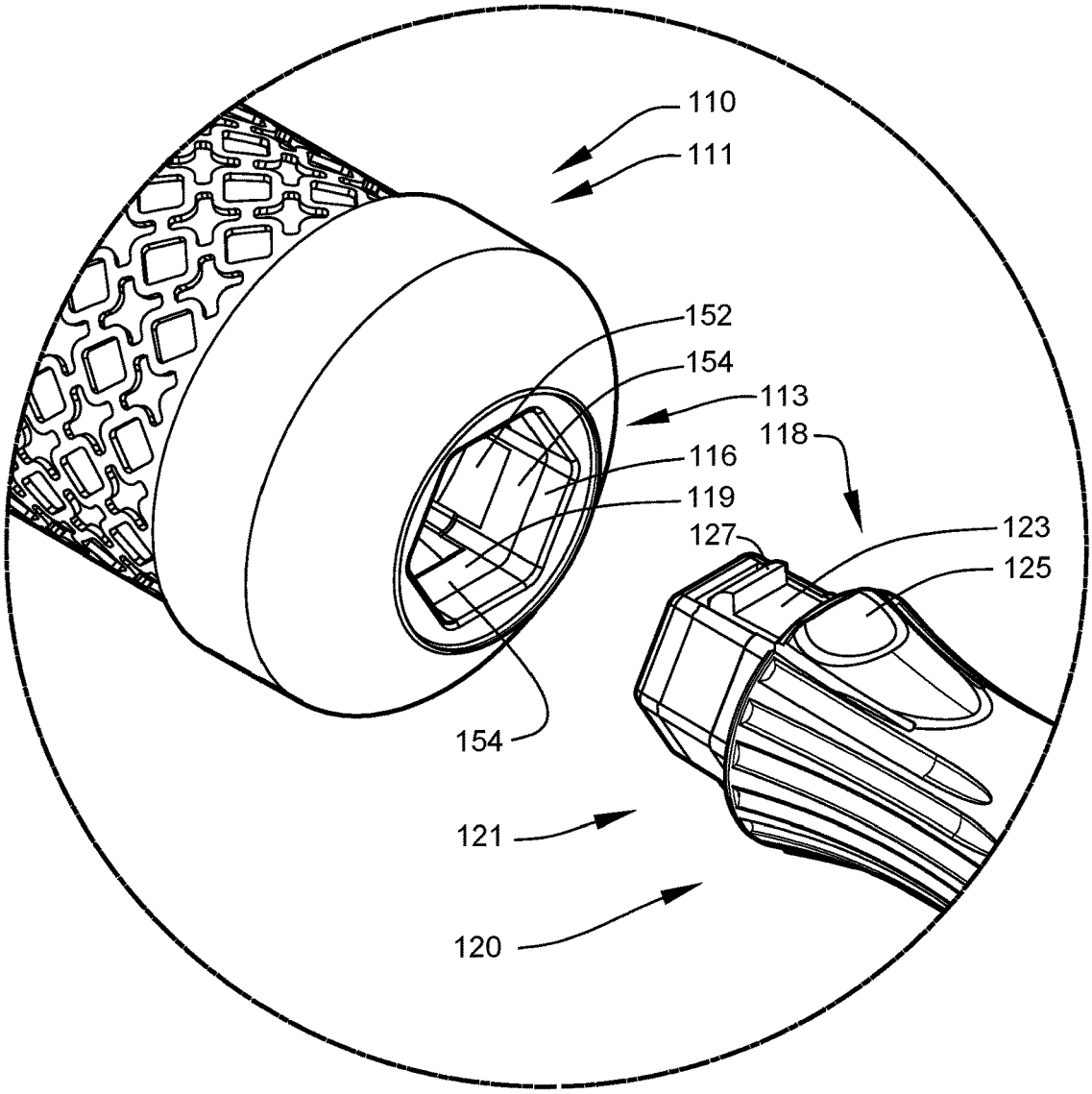
FIG. 3A is an enlarged perspective view of the separated brush head and handle of FIG. 2.
Figure 3B:
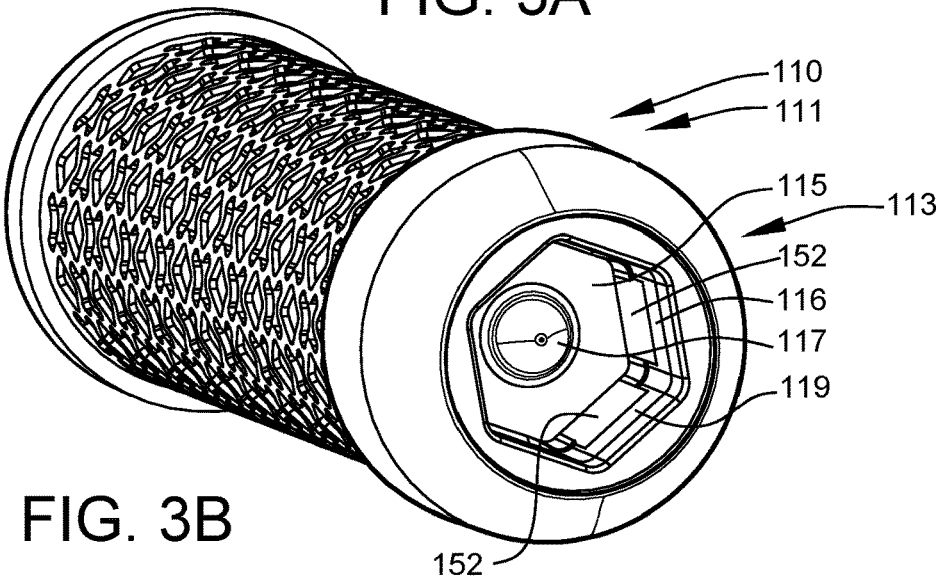
FIG. 3B is a perspective end view of the brush head of FIG. 2.
Figure 5A:
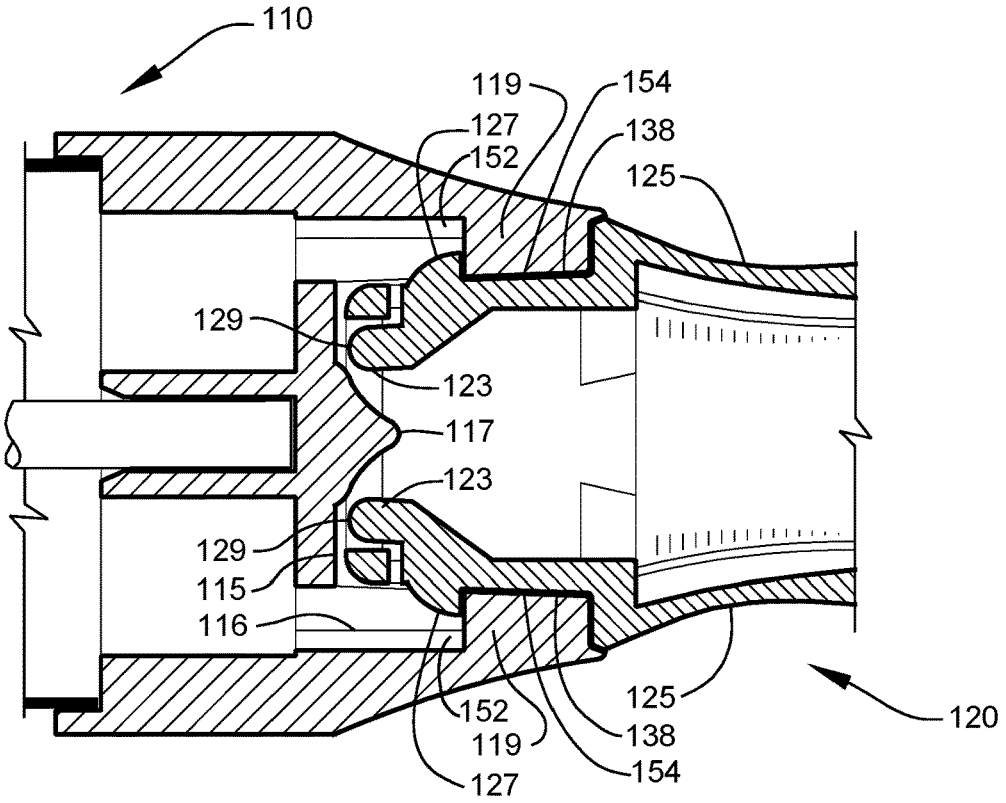
FIG. 5A is a cross sectional partial view through the section 5-5 of FIG. 4B of the brush focused on the connected female opening and male member.

FIG. 3A is an enlarged perspective view of the separated brush head and handle of FIG. 2. FIG. 3B is a perspective end view of the brush head of FIG. 2. Female opening 113 comprises an open end, as shown, (see FIG. 3A and FIG. 3B) and a back wall 115 (see FIG. 3B) connected by an inner wall 116. Protrusion 117 (shown implemented in FIG. 3B, 5A and FIG. 5B as a conical protrusion) is positioned on back wall 115. According to an implementation of the present disclosure, protrusion 117 may be centered on an axis extending perpendicular to the plane that generally defines the back wall 115, wherein the axis passes through the center point of the back wall 115. After reading the teachings of this speciation, those having ordinary skill in the art will now understand that other shapes for the protrusion, such as a cone having non-linear walls or having a frustoconical shape, may suffice. The base of protrusion 117 is connected to or formed into back wall 115 such that it extends toward the open end of female opening 113. A handle retaining structure 119 is formed into or connected to the inner wall 116. Handle retaining structure 119 of inner wall 116 comprises barb openings 152 and slot engaging wall portions 154 that will be described further herein.

Male member 121 comprises two ejection fingers 123 each in contact with a depressible actuator 125, as shown. With reference to FIG. 1, one depressible actuator is visible. Another depressible actuator is positioned on the opposite side of the handle (see FIGS. 5A and 5B). Each ejection finger 123 is flexible or capable of flexing when an external force is applied to the depressible actuator 125 that is in contact with a corresponding ejection finger 123 (see FIG. 5B). Each ejection finger 123 comprises a retaining barb 127 that engages a barb opening 152 of handle retaining structure 119 associated with female opening 113. The flexibility of each ejection finger 123 allows the retaining barb 127 to enter the handle retaining structure 119 and then expand to prevent retraction of the ejection fingers 123 and of the handle (see FIG. 5A). Each ejection finger 123 also comprises a distal end whereupon a tip 129 is positioned. The tip 129 engages the protrusion 117 of female opening 113 only when the ejection finger 123 is being flexed inward (compressed) when the handle 120 and the brush head 110 are in the connected position (see FIGS. 5A and 5B). The friction generated at the surface contact between tip 129 and protrusion 117 is reduced. This may be accomplished in many ways such as by selecting one or more of various means including selecting materials of construction having low friction and use of complementary geometric configurations. Lubrication or use of friction reducing coatings may also be used. In the implementation of FIG. 4A through 5B, the tip 129 is rounded at any given contact angle relative to the protrusion 117.

Figure 5B:
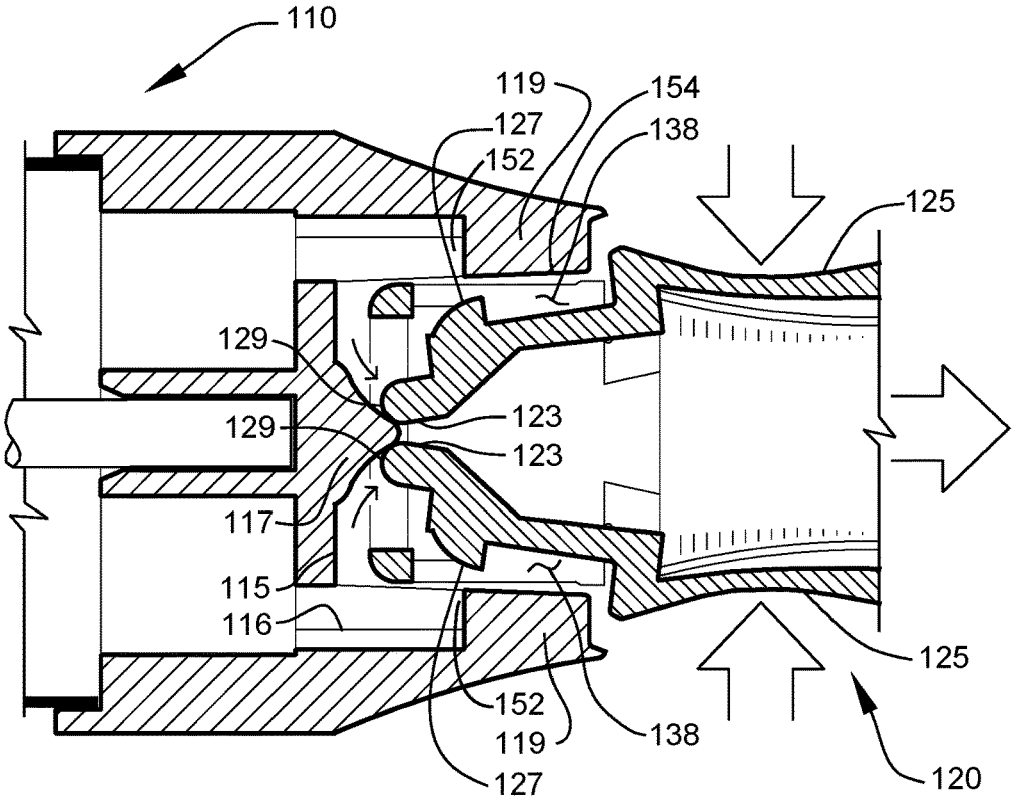
FIG. 5B is a cross sectional partial view through the section 5-5 of FIG. 4B showing the operation of an ejection mechanism provided to assist the ejection of the handle from the brush head.

In specific reference to FIG. 5B, when a user of the hair brush actuates the depressible actuator 125 of each ejection finger 123 by applying an inward force (by squeezing with the thumb and forefinger), barb 127 is first moved inward (compressed) thereby releasing the engagement with the handle retaining structure 119. As ejection finger 123 moves inward, barb 127 is disengaged from barb opening 152 and slot 138 disengages from slot engaging wall portion 154, as shown. Then, and only then, tip 129 contacts the protrusion 117 thereby converting the inward force on the ejection finger 123 into an outward force as the surface of the tip 129 slides along the surface of the protrusion 117. The outward force is directed away from the handle 120 along the axis upon which the protrusion 117 is centered, thereby causing the brush head 110 to be ejected, as shown in FIG. 5B. It is important to note that the ejection mechanism of the present disclosure does not rely on a simultaneous release and ejection mechanism that results in competing frictional forces (resulting in an unreliable means of attachment and separation that may jam). Furthermore, the handle and brush head structures of the present disclosure are well suited for the task of providing mechanical support against the load forces experienced by the typical use of the brush in the connected state. Typical hair brush use exposes the brush to opposing lateral forces applied to hair brush at the point of contact with the brush head and to the handle. The opposing forces create a mechanical stress on the points of connection between the brush head and the handle. The lack of a simultaneous release and ejection mechanism in the design of the present disclosure is also advantageous in that opposing lateral forces applied to hair brush at the point of contact with the brush head and to the handle during normal use will not accidentally cause the handle to detach from the brush head. The design of the present disclosure is also advantageous in that the brush head is not susceptible to being disengaged by normal use rotational forces. If the user of a brush intends to roll or spin the brush against the hair, the rotational forces will not accidentally release the handle from the brush head.

When the brush head 110 and the handle 120 are connected, the contact of the barb 127 against the handle retaining structure 119 provides mechanical support for the hair brush. In addition, the male member 121 comprises several other structures that provide additional mechanical support for the hair brush. The male member 121 comprises an outer wall 131, an inner wall 132, a front wall 133, and a seat 135. Seat 135 is distal to front wall 133, as shown. The front wall 133 has an opening 134 formed to receive or to allow the protrusion 117 to pass through it. The front wall 133 is connected to the seat 135 via the outer wall 131 and inner wall 132. There is a finger opening 137 in the outer wall 131 and inner wall 132 for each ejection fingers 123. More specifically, finger opening 137 exposes barb 127 and slot 138 of ejection finger 123. The outer wall 131 is positioned coplanar (flush) with the non-barbed portion of each ejection finger 123, so that the outer wall 131 can slide into and engage with the handle retaining structure 119 of the female opening 113. The seat 135 is formed into or connected to the outer wall 131 such that a slot 138 for receiving the handle retaining structure 119 is formed between the barb 127 and the seat 135. The seat 135 has a diameter that is greater than the diameter of the handle retaining structure 119, such that when the male member is fully inserted into the female opening the brush head rests on seat 135.

Figure 4A:
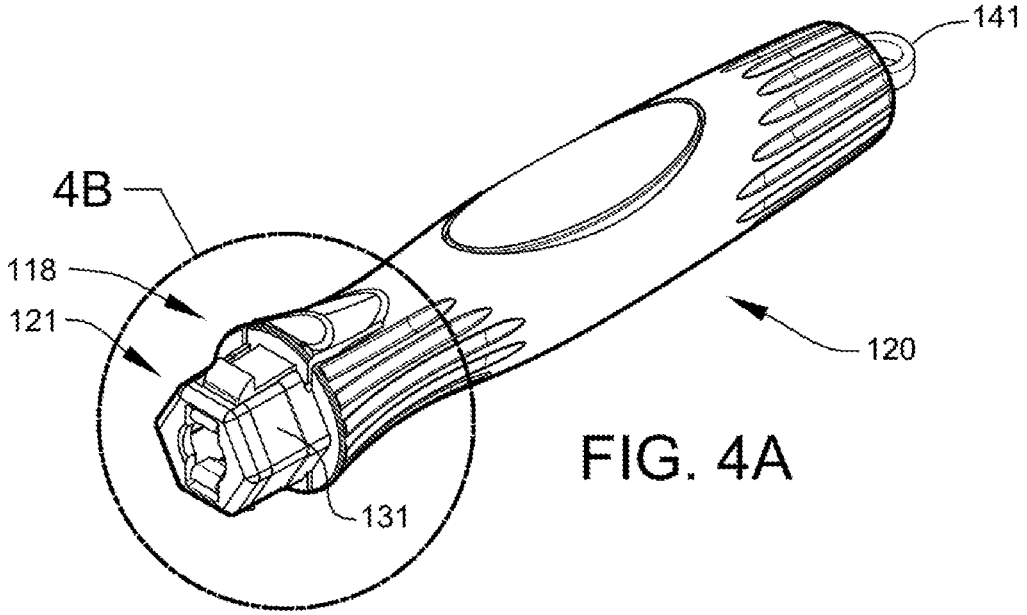
FIG. 4A is a perspective view of the handle with an enlarged view of the male member of the handle.
Figure 4B:
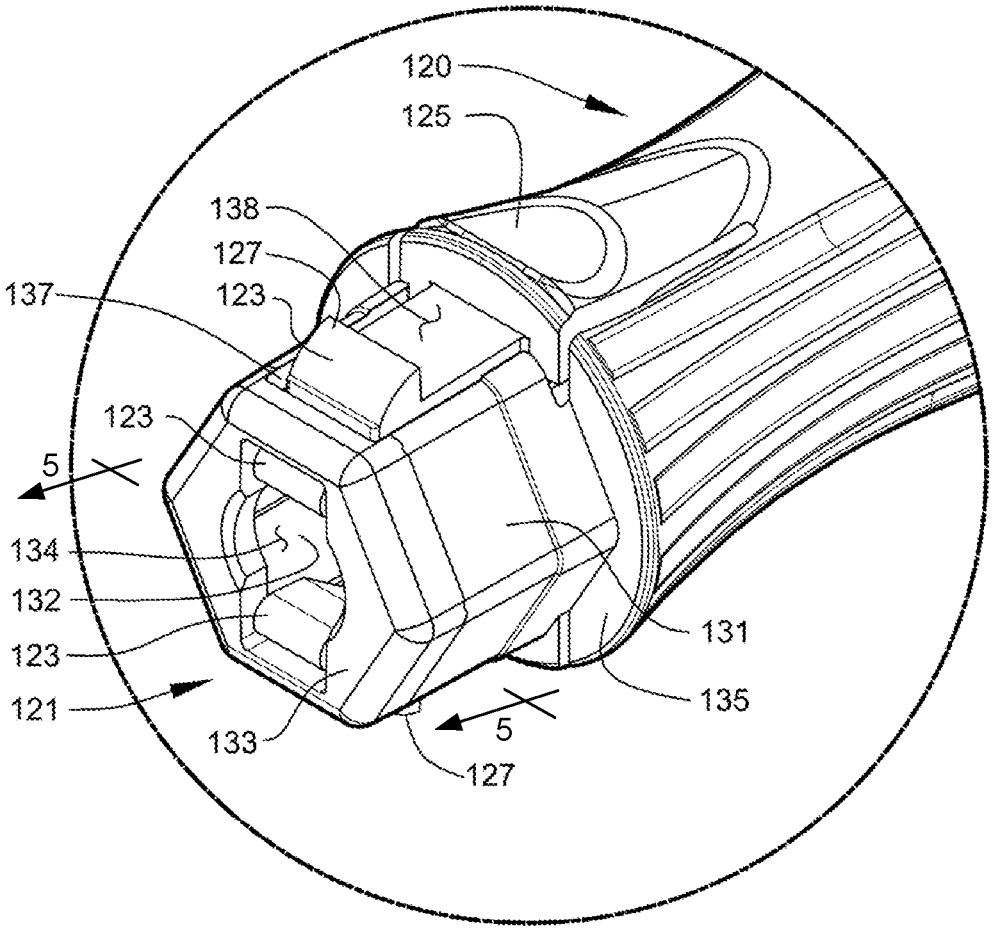
FIG. 4B is the enlarged detail view 4B of FIG. 4A, showing the male member of the handle.

In some implementations of the present disclosure, the ejection finger 123 is positioned such that the seat 135 is located between the barb 127 and the depressible actuator 125. In these implementations, the seat 135 may be formed from separate pieces such that the flex and movement of the ejection finger 123 is not restricted (see FIG. 4A and FIG. 4B). In FIG. 4B, ejection finger 123 is labeled twice to illustrate the visible portions of ejection finger 123 relative to outer wall 131 and front wall 133.

In some implementations of the present disclosure, the male member 121 and the handle retaining structure 119 are each defined by separate but corresponding cross sections that are polygonal to enhance the mechanical support between the handle 120 and the brush head 110. The non-cylindrical shape prevents rotational sliding of the male member 121 relative to female opening 113 when the two are engaged. In one implementation depicted in FIG. 4A through FIG. 5B, male member 121 is hexagonally shaped wherein each ejection finger 123 is positioned on opposing separate faces of the male member 121. The tip 129 of the ejection finger 123 is shaped to pass under outer wall 131 of the male member 121, and through an opening formed into front wall 133, as shown. After reading the teachings of this specification, those having ordinary skill in the art will no understand that a male member 121 could be configured with a different polygonal cross section or other non-cylindrical shape. In the implementation shown in FIG. 4A, through FIG. 5B, the hexagon is used for the even number of sides which allows for opposing pairs of the ejection finger 123 to be used and requires fewer degrees of rotation to achieve alignment with the female opening 113 compared to other cross-sectional shapes with fewer sides (faces).

In the hexagonal implementation of the handle retaining structure 119, each wall of the handle retaining structure 119 comprises a barb opening 152 and a slot engaging wall portion 154. In other words, there are six barb openings 152 and six slot engaging wall portions 154. With reference to FIG. 3B, not all six barb openings 152 and six slot engaging wall portions 154 are visible. It is noted that the six barb openings 152 and six slot engaging wall portions 154 each occupy a face of the hexagonal cross-section shown. This arrangement permits the handle to be inserted so that opposing barbs and slots of the male member will engage opposing barb openings and slot engaging walls of the handle retaining structure. In the hexagonal implementation, and in other cross-section implementations, each barb opening is separated by inner wall 116 connecting back wall 115 to the handle retaining structure 119 and female opening 113.

In the implementation depicted in the figures, there are two ejection fingers 123 positioned opposite one another as shown in FIG. 4A through FIG. 5B. This allows the user to quickly use one hand to eject the brush head with a pinching or squeezing of the user's thumb and forefinger.

In some implementations, the handle 120 further comprises a cavity 140 positioned on the second distal end 122 of the handle 120 wherein a hair sectioning pick 141 is stored.

Referring again to FIG. 2, in some related implementations, the hair sectioning pick 141 (an optional feature) comprises a point tipped shank 143 connected to a retaining tang 145. The retaining tang 145 of the hair sectioning pick 141 engages with the cavity 140 to attach hair sectioning pick 141 to the handle 120. In a first position, the shank 143 is concealed within the cavity 140. In a second position, the shank 143 is exposed, protruding outward from the handle 120. A user can toggle the hair sectioning pick 141 between the two positions by pulling the hair sectioning pick 141 out of the cavity 140 and flipping the hair sectioning pick 141 around 180 degrees before reinserting it into the cavity 140.

In some implementations, the handle has been optimized for comfort of the hand while holding. The handle may have an ergonomic shape, a resiliently deformable surface (such as rubber or rubberized silicone coatings), or a friction enhancer (such as rubber or rubberized silicone coatings, or grip enhancing shallow grooves formed into the handle's surface). In some implementations, handle 120 may have region 150 on the surface configured to receive a graphic design (to include aesthetic decorative elements, marketing elements, trademarks, etc.) via means such as direct printing, stamping, embossed formation, engraved formation, or via applied films (i.e., adhered labels).

According to one implementation of the present disclosure, each ejection finger 123 is made of a nylon material. This material is chosen so that the ejection will continue to work effectively over a long period of time. The nylon material will not wear out even after multiple uses.

Figure 6:
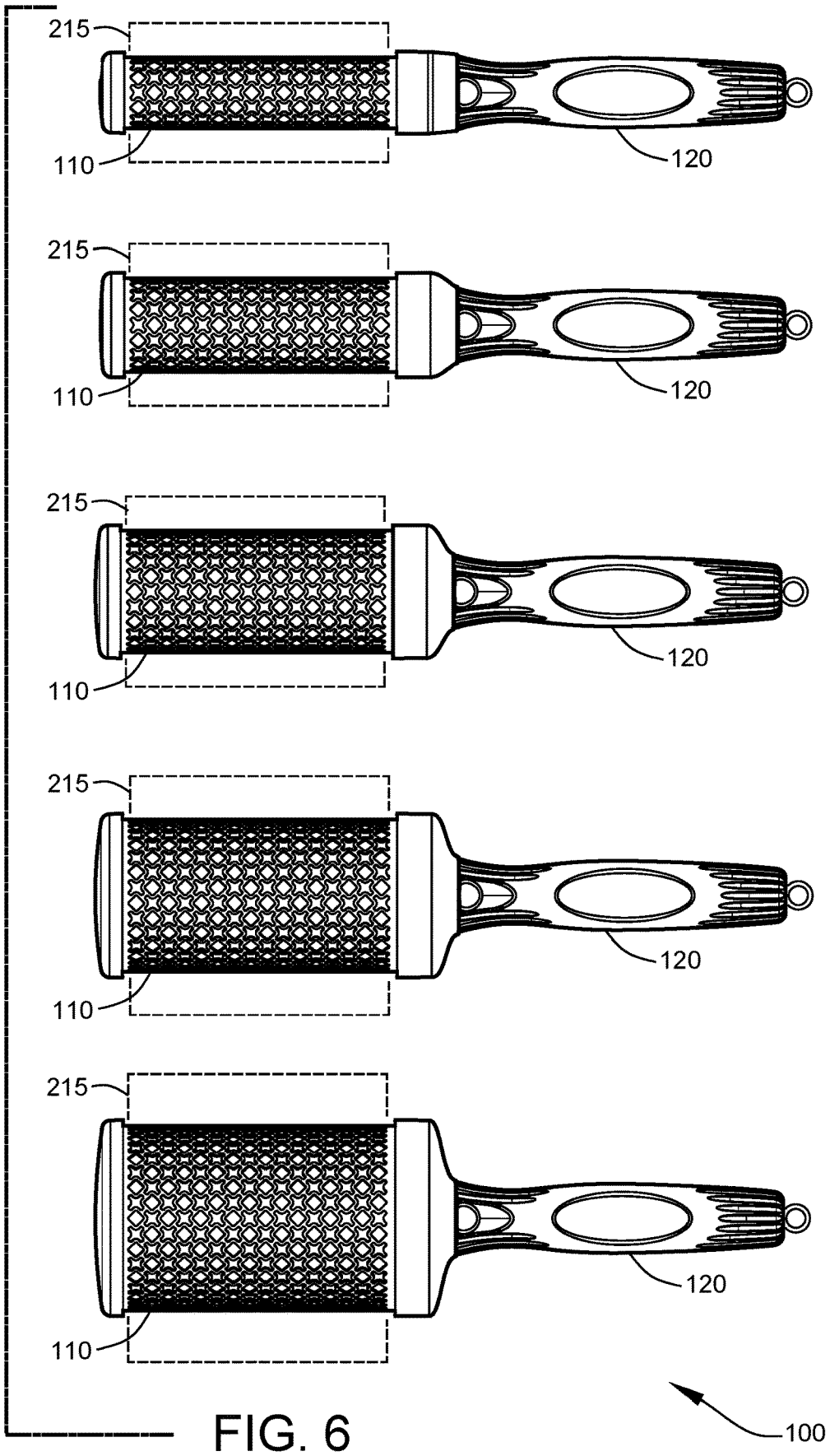
FIG. 6 shows the hair brush of the present disclosure illustrating brush heads of different sizes.
Figure 7:
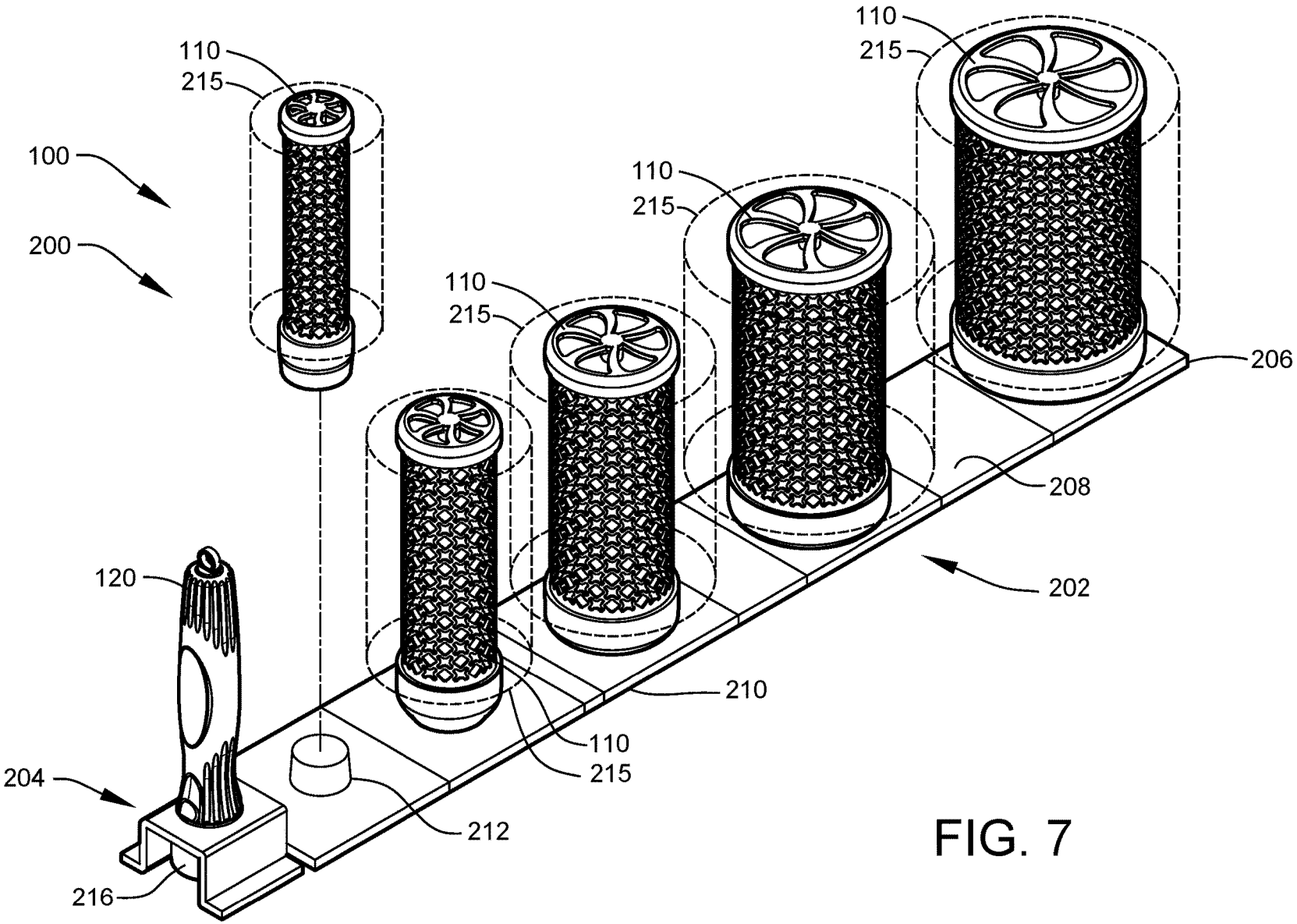
FIG. 7 is perspective view showing the brush heads and handle of FIG. 6 supportively engaged with a storage organizer.
Figure 8:
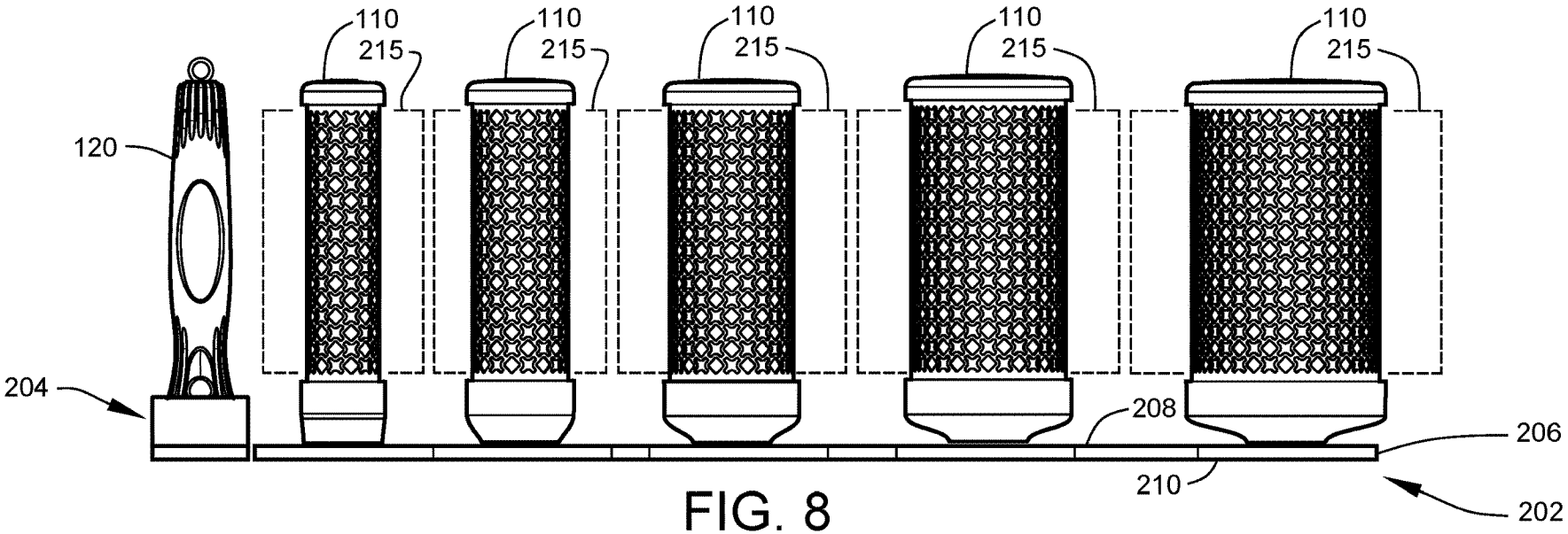
FIG. 8 is an elevational view showing the storage organizer of FIG. 7.
Figure 9:
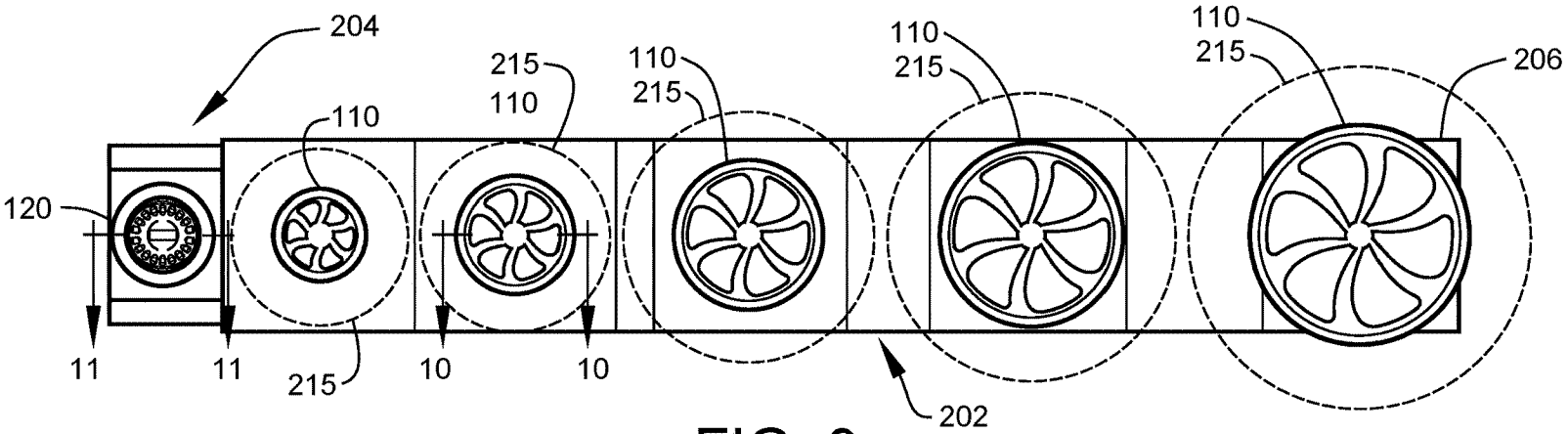
FIG. 9 is a top view further illustrating the arrangements of the storage organizer of FIG. 7.

FIG. 6 shows the brush handle of the present disclosure illustrating a set of brush heads of different sizes. Bristles 215 are depicted schematically. FIG. 7 is a perspective view showing the brush heads 110 and handle 120 of FIG. 6 supportively engaged with a storage organizer 200. FIG. 8 is an elevational view showing the storage organizer 200. FIG. 9 is a top view further illustrating the arrangements of the storage organizer 200 of FIG. 7. The storage organizer 200 is suitable for storing one or more brush heads 110 and the handle 120 in an organized and conveniently-accessible manner. In the depicted implementation, the storage organizer 200 includes a brush-head support section 202 and a handle support section 204. The storage organizer 200 may support brush heads of different sizes, of the same size, or any combination of brush head sizes.

The brush-head support section 202 may include base member 206 that is elongated and planar having an upper surface 208 and a lower surface 210. The lower surface 210 of the brush-head support section 202 may be adapted to rest on a table or other horizontal support. In the present implementation, the base member 206 comprises a generally rectangular shape. In other implementations, the base member 206 may have a circular shape or may be triangular, pentagonal, hexagonal or other polyhedral shape.

Figure 10:
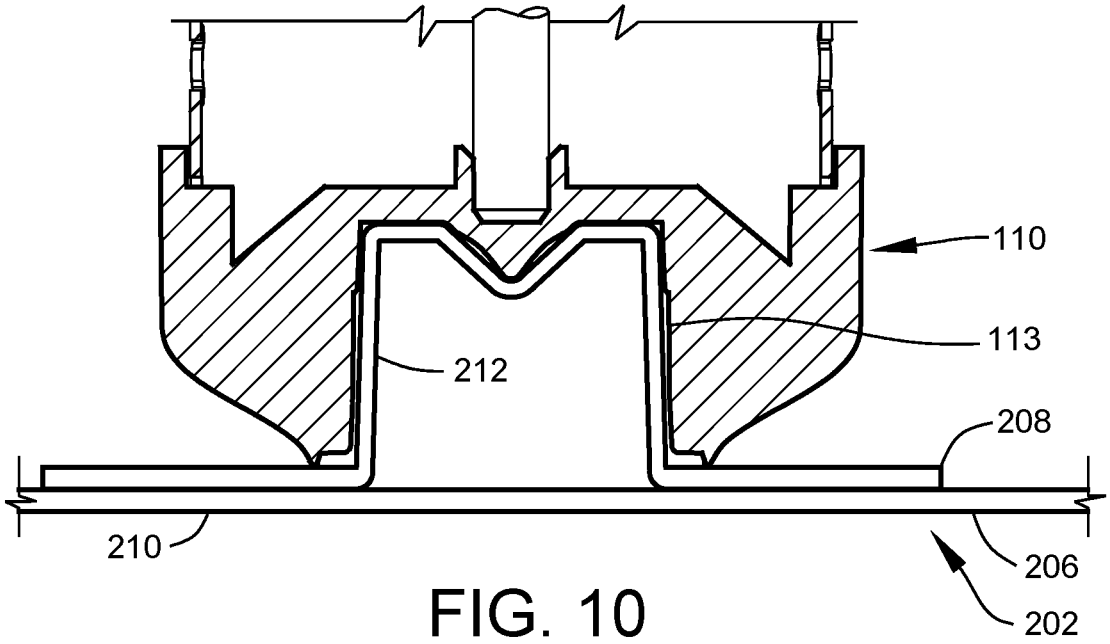
FIG. 10 is a partial cross-sectional view, through the section 10-10 of FIG. 9, showing an upwardly-projecting post member of the storage organizer adapted to supportively engage the female opening of a selected brush head.

FIG. 10 is a partial cross-sectional view, through the section 10-10 of FIG. 9, showing a post member 212 of the brush-head support section 202 supportively engaging the female opening 113 of a selected brush head 110. The post member 212 functions to support the brush head 110 on the brush-head support section 202 in a stable and generally vertical orientation, as shown. Each post member 212 comprises a size and shape corresponding to the interior of the female opening 113, as shown. The post member 212 is designed to allow the brush head 110 to be pressed securely onto the post member 212 for storage yet permits the brush head 110 to be easily withdrawn from the post when required for use. The plurality of post members 212 are joined to the upper surface 208 in a spaced-apart arrangement that accommodates the various brush sizes without the bristles 215 of adjacent brush heads touching.

Figure 11:
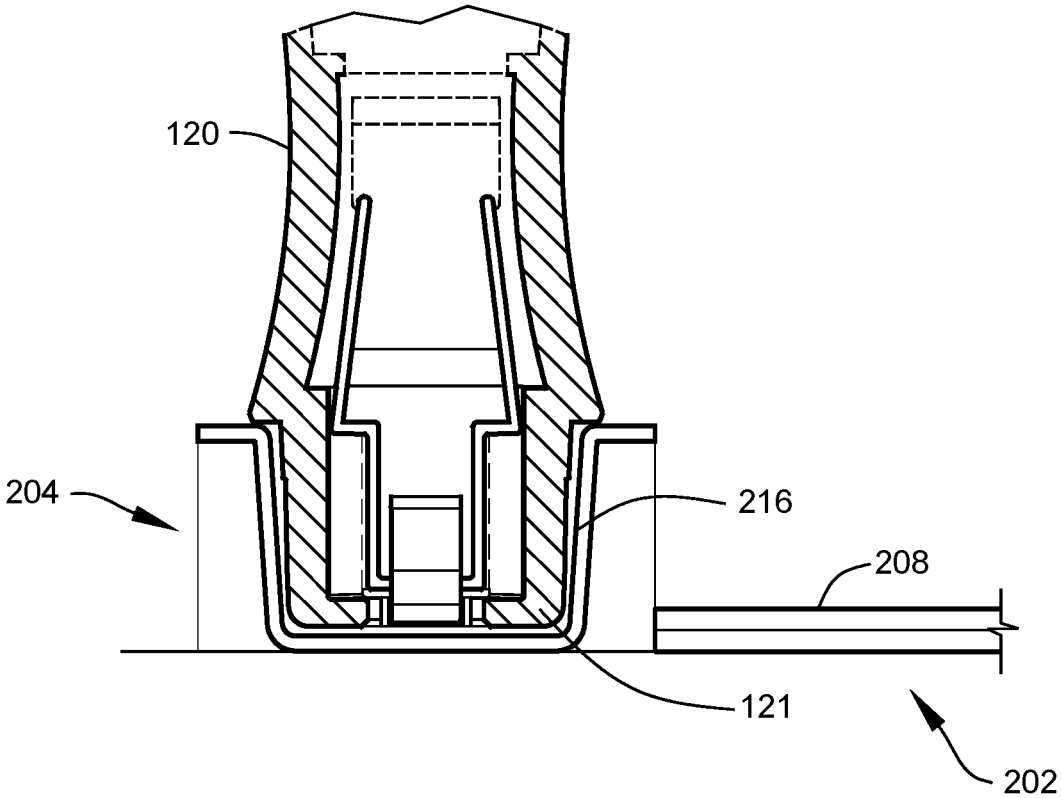
FIG. 11 is a partial cross-sectional view, through the section 11-11 of FIG. 9, showing a supportive receiving socket of the storage organizer adapted to supportively receive the male member of the handle.

The handle support section 204 consists of a rigid frame having a receiving socket 216 adapted to supportively receive the male member 121 of the handle 120, as best illustrated in FIG. 11. FIG. 11 is a partial cross-sectional view, through the section 11-11 of FIG. 9, showing the arrangements of the receiving socket 216 located within the handle support section 204. The receiving socket 216 functions to support the handle 120 in a stable and generally vertical orientation, as shown in FIG. 7 and FIG. 8. The receiving socket 216 comprises a size and shape corresponding to the exterior geometry of the male member 121, thus allowing the handle 120 to be pressed securely into the socket during storage yet permitting the handle to be easily withdrawn when needed.

The various components of storage organizer 200 may be constructed from plastic, wood, metal, or other material, or any combination thereof, and may be fabricated using molding, casting, machining and/or other fabrication techniques known by those skilled in the art.

Figure 12:
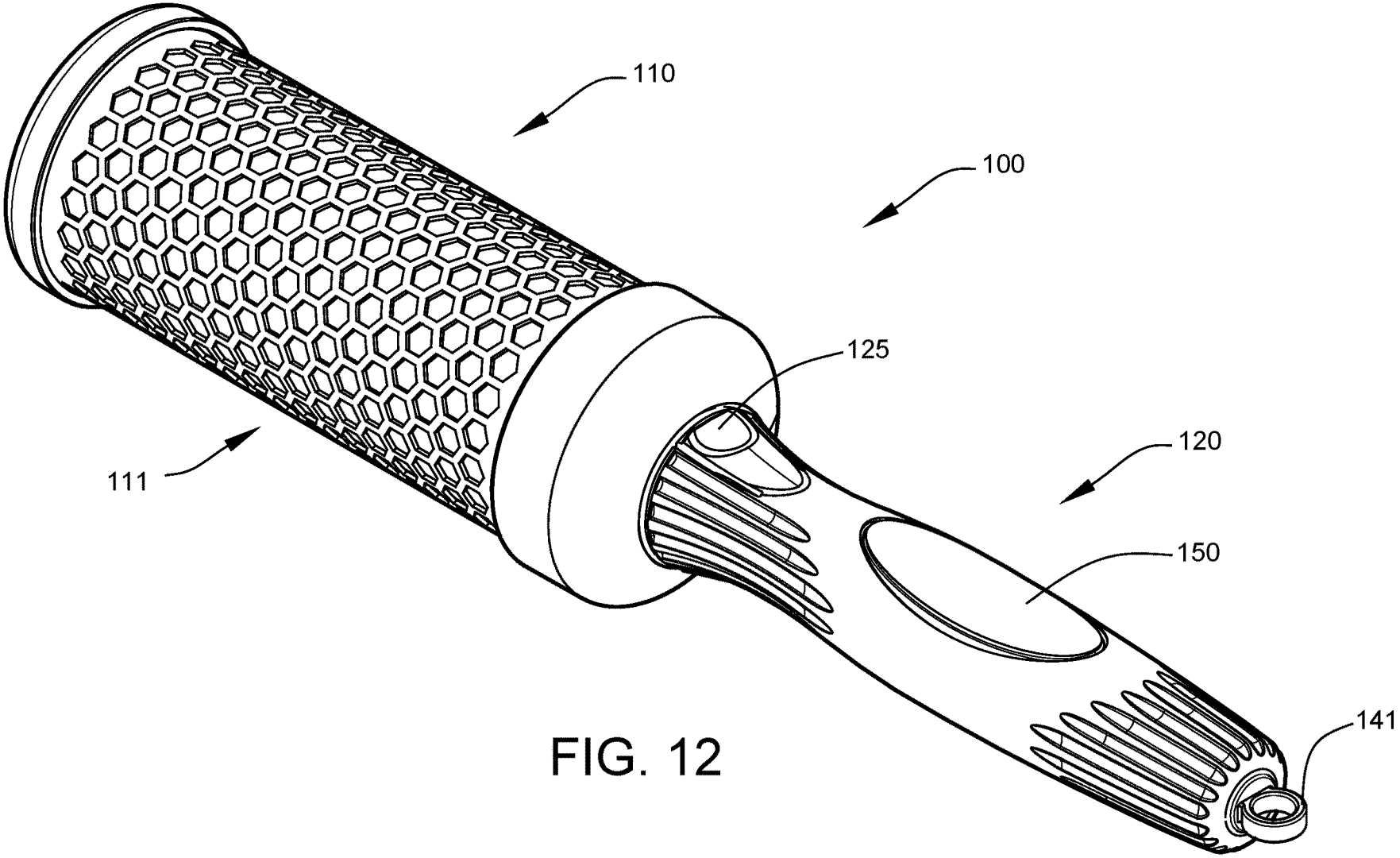
FIG. 12 is a perspective view showing a hair brush according to an implementation of the present disclosure illustrating bristle openings than differ from the hair brush of FIG. 1.

FIG. 12 is a perspective view showing a hair brush according to an implementation of the present disclosure illustrating different bristle openings than the implementation of the hair brush of FIG. 1. Other bristle openings other than those illustrated in the implementations of the present disclosure may suffice as well.

In some implementations of the present disclosure, the brush heads comprise ceramic. Brush head barrel 111 may be ceramic, ceramic plated, or have metal with a ceramic coating.

The above disclosure has been made only by way of example. It should be understood that the invention is not intended to be limited to the particular forms disclosed. Furthermore, the invention is amenable to various modifications and alternative forms. Variations and other various changes in the composition, combination, and arrangement of parts can be utilized to by those skilled in the art without departing from the spirit and scope of the invention, as herein disclosed and claimed.

What is claimed is:

1. A hair brush comprising:

a brush head comprising a female opening, the female opening comprising a back wall, the back wall connected to a handle retaining structure, and a protrusion on the back wall, the protrusion extending toward the handle retaining structure;

a handle comprising a male member configured to enter the female opening and connect with the handle retaining structure;

the male member comprising a seat, a front wall, and an outer wall;

the seat positioned distal to the front wall;

the seat and the front wall connected by the outer wall;

the front wall comprising an opening to receive the protrusion of the female opening;

a pair of ejection fingers integrated with the handle;

each ejection finger comprising a tip, a barb, and a slot formed between the barb and the seat;

the outer wall comprising at least two openings exposing the barb and the slot of each ejection finger;

the handle retaining structure comprising at least two barb openings and at least two slot engaging walls;

at least two depressible actuators positioned on the handle and in mechanical contact with each ejection finger;

the tip of each ejection finger is out of contact with the protrusion of the female opening when the male member is inserted into the female opening and when each barb is engaged with each barb opening of the handle retaining structure and each slot is engaged with the slot engaging wall of the handle retaining structure;

and the tip of each ejection finger approaches and then contacts the protrusion of the female opening to eject the brush head from the handle after the barb is disengaged from the barb opening of the handle retaining structure and the slot is disengaged from the slot engaging wall of the handle retaining structure upon depressing the depressible actuators so that the tip of each ejection finger contacts and slides along the protrusion ejecting the brush head from the handle.

2. The hair brush of claim 1, wherein the protrusion is centered on the back wall.

3. The hair brush of claim 1, wherein the protrusion comprises a conical shape.

4. The hair brush of claim 1, wherein the protrusion has a conical shape and is centered on the back wall.

5. The hair brush of claim 1, the handle retaining structure comprising six barb openings and six slot engaging walls.

6. The hair brush of claim 1, the female opening having a non-cylindrical cross section that defines the handle retaining structure and the male member having a corresponding non-cylindrical cross section that defines the outer wall.

7. The hair brush of claim 6, wherein the non-cylindrical cross section of the female opening that defines the handle retaining structure and the corresponding non-cylindrical cross section that defines the outer wall of the male member are hexagonal.

8. The hair brush of claim 7, the handle retaining structure comprising six barb openings and six slot engaging walls.

9. The hair brush of claim 1, the pair of ejection fingers being positioned on opposing sides of the handle.

10. The hair brush of claim 1, said handle further comprising a cavity connecting to a hair sectioning pick that is removable, the hair sectioning pick comprising a shank and a tang that allow the hair sectioning pick to be inserted into the cavity in a first position wherein the shank is concealed by the cavity and a second position wherein the shank extends outward and away from the cavity.

11. The hair brush of claim 1, the brush head comprising ceramic.

12. The hair brush of claim 1, the handle comprising at least one grip enhancing feature.

13. The hair brush of claim 1, the handle comprising a region for receiving one or more designs.

14. The hair brush of claim 1, further comprising a storage organizer to store the brush head and the handle.

15. The hair brush of claim 14, the storage organizer comprising at least one post member to supportively engage the female opening of the brush head.

16. The hair brush of claim 14, the storage organizer further comprising at least one receiving socket to supportively receive the male member of the handle.

17. A hair brush comprising:

a handle comprising an ejection mechanism, the ejection mechanism comprising two depressible actuators and two ejection fingers, each depressible actuator connected to one of the two ejection fingers;

a brush head comprising an opening to receive the handle;

the brush head comprising a conical protrusion within the opening that the two ejection fingers do not contact when the brush head is connected to the handle; and the ejection mechanism ejects the brush head from the handle when depressing the two depressible actuators causing the two ejection fingers to move toward and contact the conical protrusion and then to slide along the conical protrusion to eject the brush head from the handle.

18. The hair brush of claim 15, the storage organizer further comprising at least one receiving socket to supportively receive the male member of the handle.

* * * * *